US005417544A

United States Patent [19]

Mohn

[11] Patent Number: 5,417,544

[45] Date of Patent: May 23, 1995

[54] PUMP OR COMPRESSOR UNIT

[75] Inventor: Frank Mohn, London, England

[73] Assignee: Framo Developments (UK) Limited, London, England

[21] Appl. No.: 838,759

[22] PCT Filed: Sep. 18, 1990

[86] PCT No.: PCT/GB90/01435

§ 371 Date: May 8, 1992

§ 102(e) Date: May 8, 1992

[87] PCT Pub. No.: WO91/04417

PCT Pub. Date: Apr. 4, 1991

[30] Foreign Application Priority Data

Sep. 18, 1989 [GB] United Kingdom ..... 8921071

[51] Int. Cl.[6] ..... F01D 1/24

[52] U.S. Cl. ..... 415/64; 415/213.1; 417/423.8

[58] Field of Search ..... 415/64, 65, 66, 67, 415/68, 69, 7, 213.1; 417/423.8

[56] References Cited

U.S. PATENT DOCUMENTS

| | | | |
|---|---|---|---|
| 693,946 | 2/1902 | Boyce | 415/64 |
| 1,223,342 | 4/1917 | London | 415/64 |
| 1,944,537 | 1/1934 | Wiberg et al. | 415/64 |
| 2,318,990 | 5/1943 | Doran . | |
| 2,361,726 | 10/1944 | Weimar . | |
| 2,589,239 | 3/1952 | Fallon | 415/64 |
| 3,040,971 | 6/1961 | Pavlecka | 415/64 |
| 3,044,685 | 7/1962 | Lapiken . | |
| 3,314,647 | 4/1967 | Pavlecka | 415/64 |
| 3,726,619 | 4/1973 | Adams | 415/64 |
| 3,749,510 | 7/1973 | Gabryk | 415/64 |
| 4,990,068 | 2/1991 | Zhong et al. | 417/423.8 |

FOREIGN PATENT DOCUMENTS

| | | | |
|---|---|---|---|
| 0063444 | 10/1982 | European Pat. Off. . | |
| 813337 | 5/1937 | France . | |
| 2589529 | 5/1987 | France . | |
| 550995 | 5/1932 | Germany | 415/64 |
| 2344486 | 3/1974 | Germany | 417/423.8 |
| 99741 | 8/1940 | Sweden | 415/64 |
| 1511461 | 9/1989 | U.S.S.R. . | |
| WO86/05557 | 9/1986 | WIPO . | |

*Primary Examiner*—John T. Kwon
*Attorney, Agent, or Firm*—Young & Thompson

[57] ABSTRACT

A pump or compressor module for undersea use has a housing having a pump or compressor unit received therein. The pump or compressor unit has first and second impeller assemblies. The first and second impeller assemblies are driven in opposed directions about a common axis. The drive has first and second electric motors having respective drive shafts drivingly connected to the first and second impeller assemblies respectively. First and second motor casings contain the first and second motors respectively, the motor casings being within the housing. There is a seal compartment in each of the motor casings and a drive shaft seal within each of seal compartments. Barrier fluid is supplied to each of the seal compartments at a higher pressure than to the rest of the motor casing. The housing has end portions accommodating the first and a second electric motors respectively and a central portion between the end portions accommodating the impeller assemblies, and providing an inlet chamber communicating with a fluid inlet.

4 Claims, 6 Drawing Sheets

FIG. 6
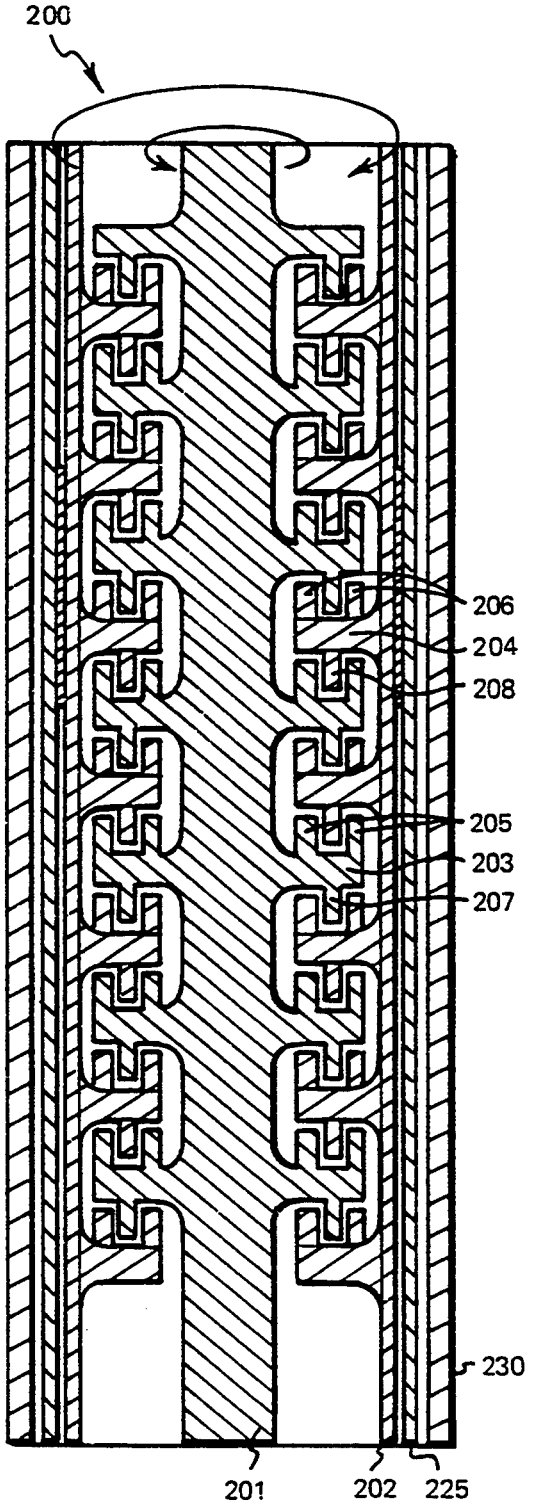
FIG. 7
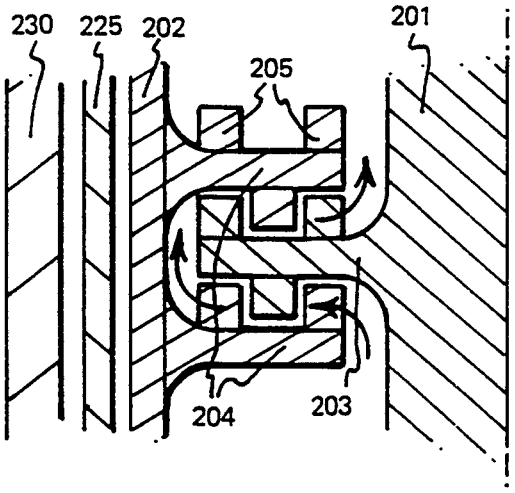
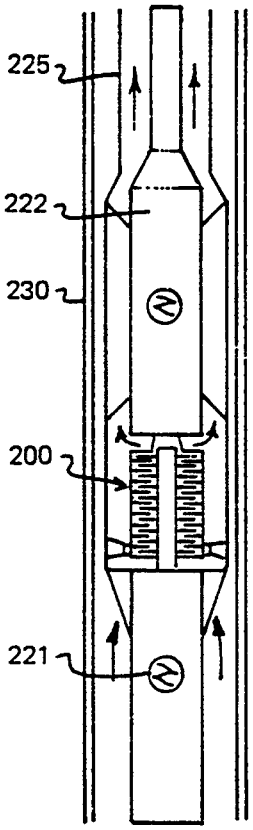
FIG. 8

PUMP OR COMPRESSOR UNIT

The invention relates to a pump or compressor unit.

In conventional contra-rotating pump or compressor units, as shown for example in U.S. Pat. No. 2,234,733 to Jendrassik, contra-rotating impeller blades are shaped so as to induce fluid flow in the axial direction.

In contrast, the present invention provides a pump or compressor unit comprising at least one first impeller means and at least one second impeller means adjacent the first impeller means on a common axis, the first and second impeller means each being arrange to move a fluid in a direction generally radially of the axis on relative rotation of the impeller means about the axis.

Pumps or compressors in accordance with the present invention can be designed so as to provide considerable advantages in respect of size and general configuration, and hence in overall efficiency, making them useful primarily but not exclusively in oil extraction applications, particularly where a multi-phase fluid is to be moved.

A pump or compressor unit embodying the invention can be of various multistage constructions and although preferably contra-rotating can incorporate stationary guide or impeller means co-operating with rotating impeller means.

In a convenient embodiment of the invention, the impeller means comprise two coaxial impeller assemblies each having a backing or support plate mounting one or more annular arrays or rings of angularly spaced impeller vanes or blades. The blades extend axially of the assemblies from the support plate mounting them to close adjacency with the opposed support plate, and the blade rings of the two assemblies are located concentrically in close radial adjacency. Both of the support plates may have a multiplicity of the impeller blade rings, so that all but the outermost rings are each received between an adjacent pair of the blade rings of the other assembly.

To minimize leakage back from the pressure to the suction side, the outer tips of the blades can be sealed to the opposed support plate by sealing means carried by a support ring which connects the tops of each ring of blades and mechanically supports them.

The impeller blades have profiles which are such that a continuous fluid pumping or compression function in a radial direction results from contrary rotation of the support plates. The rotational component of fluid velocity created by each ring of blades is converted to compression energy in the following ring of blades in the direction of radial flow, which ring acts as a rotating diffuser. By this arrangement a multistage unit can be provided which is axially very compact. The relative velocity increases from the fluid inlet to the outlet, so that an increasing absolute head generation per ring of blades will increase considerably towards the outlet. The inlet can thus be optimised for fluids likely to cause cavitation, and at the same time a high specific and absolute load on the profiled blades at the outer part of the support plates can be achieved.

The impeller assemblies can be driven at relative moderate speeds to achieve good suction performance as well as a high energy output typical of high speed machines.

The axial extent of the impeller blades can be successively reduced in the flow direction so as to match the axial velocity to each ring of impeller blades. A given loading (lift coefficient) can be designed for each row. For multiphase or other compressible fluids, this variable inlet area capability provides optimum loading for the design operating condition and can serve to "unload" or decouple the drive motors in slug flow conditions.

The counter-rotating action of the rings of impeller blades will also provide good mixing of multiphase mixtures. A relative short "hold time" of the fluid in the impeller system will also prevent separation.

A pump or compressor unit in accordance with the invention can be arranged to effect fluid movement in either radial direction, because the head generating principle depends on the hydrodynamic function of the axial profiling of the impeller blades and not directly on the centrifugal force field generated by the rotation of the impeller assemblies. Especially for large incoming volumes of multiphase fluids at relatively low absolute pressure, a radially inward movement of the fluid will give advantages because a large reduction of volumes takes place between the suction and the discharge side.

Although pump units embodying the invention can be designed for fluid movement in one radial direction only, thus from a central suction inlet to an outer discharge, or vice versa, the units can provide for successive radial movements in opposite directions. A first impeller assembly with one or more axially extending rings of impeller blades on each side can thus be received between two assemblies, rotatable in common, each having one or more co-operating rings of impeller blades extending towards the first assembly. A plurality of such impeller arrangements can be placed in axial adjacency and in communication to provide a multistage unit of some axial length but of small lateral dimension. An arrangement of this sort can provide a downhole "wet compressor" unit which is capable of generating a sufficient head to lift a liquid/gas mixture with a high gas content directly from a well, without the need for a downhole separator upstream of the unit.

The drive means for the impeller means can comprise separate electric, hydraulic or pneumatic motors axially spaced with the impeller means between them. Close coupled oil cooled electric motors can be used in a sealed or "canned" unit which is of special interest for installations where leakages to or from the unit can be critical, for example in subsea installations to prevent water ingress, and in topside applications to prevent pumped fluid leakage to the surroundings.

A separate high pressure seal chamber can be provided, so that a lower pressure can be maintained in the actual motor chamber.

The invention is further described below, by way of example, with reference to the accompanying drawings, in which.

Figures 1, 1A, 1B:
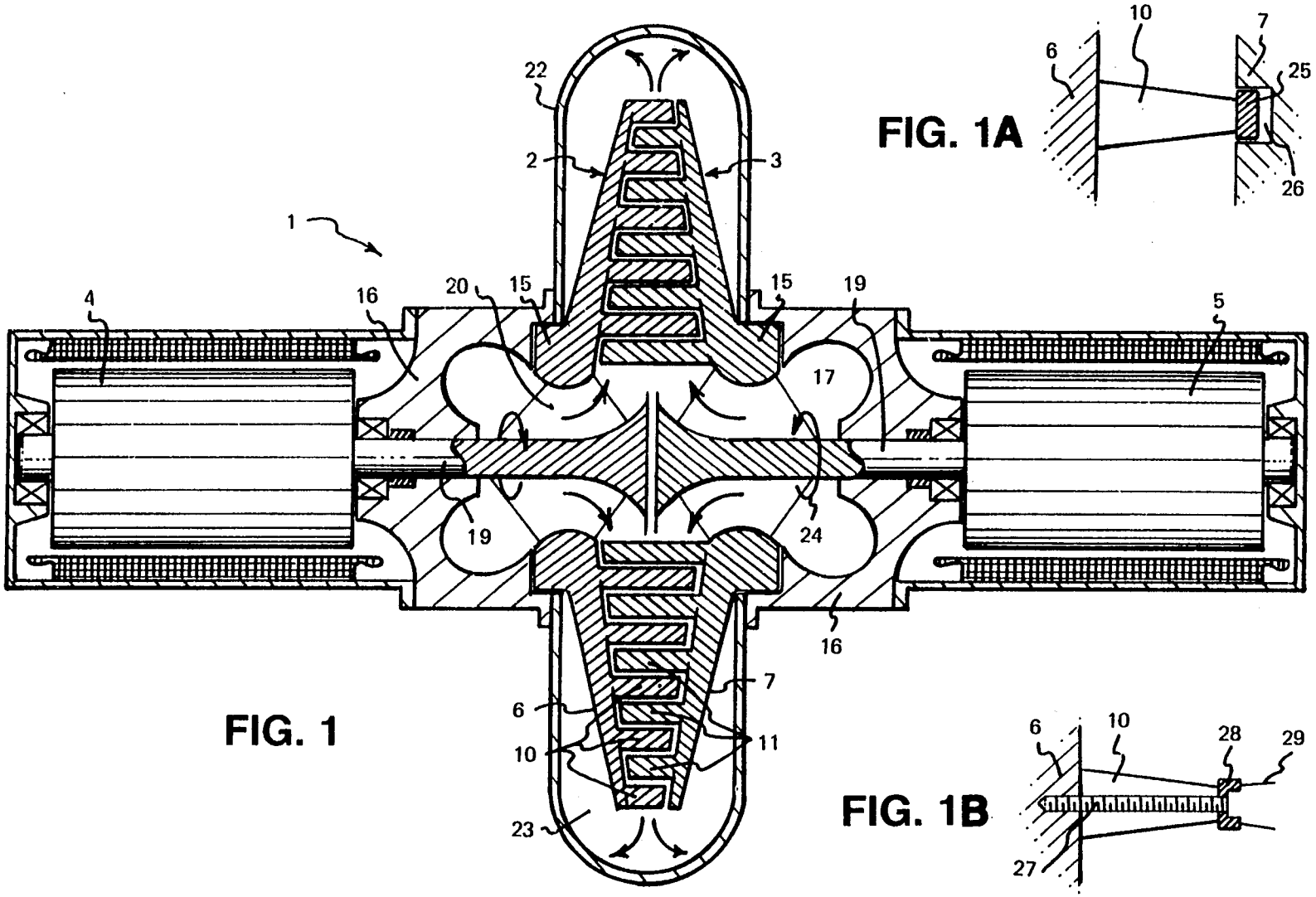
FIG. 1 is a sectional side view of a first pump or compressor unit embodying the invention having contra-rotating impeller assemblies.
FIGS. 1A & 1B are fragmentary views of the unit of FIG. 1 showing respective different modifications.
Figure 2:
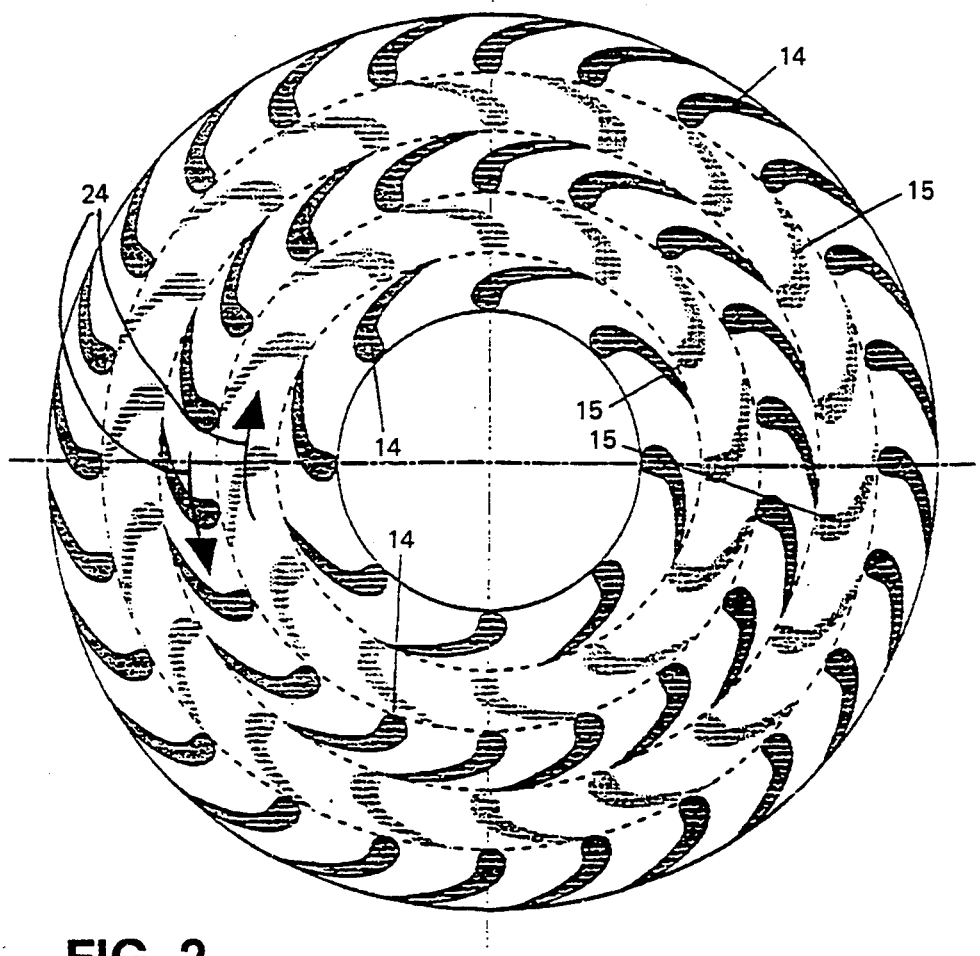
FIG. 2 is a sectional end view through the impeller assemblies of the unit of FIG. 1, on the II—II and on a larger scale.
Figure 4:
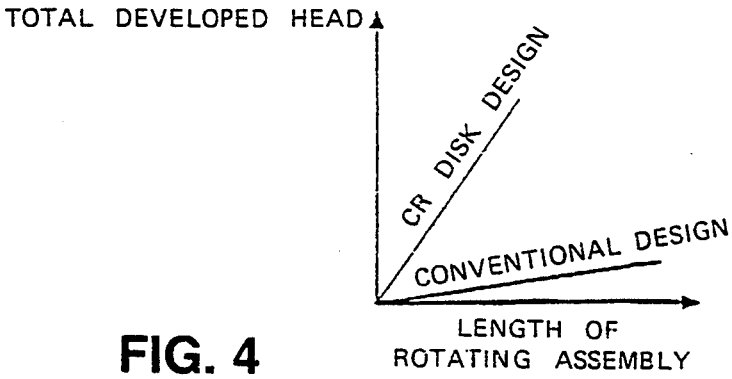
Figure 5:
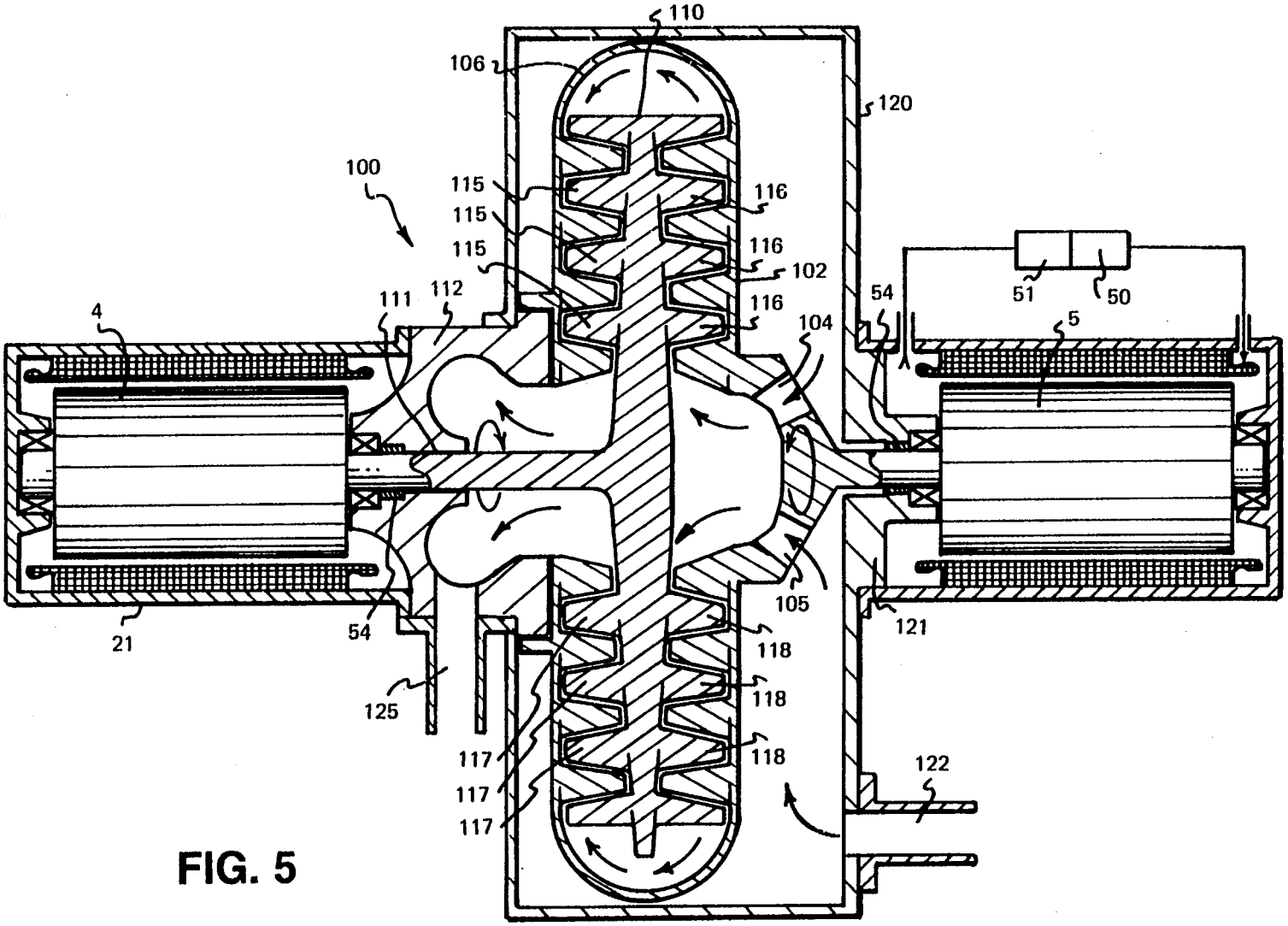
Figure 9:
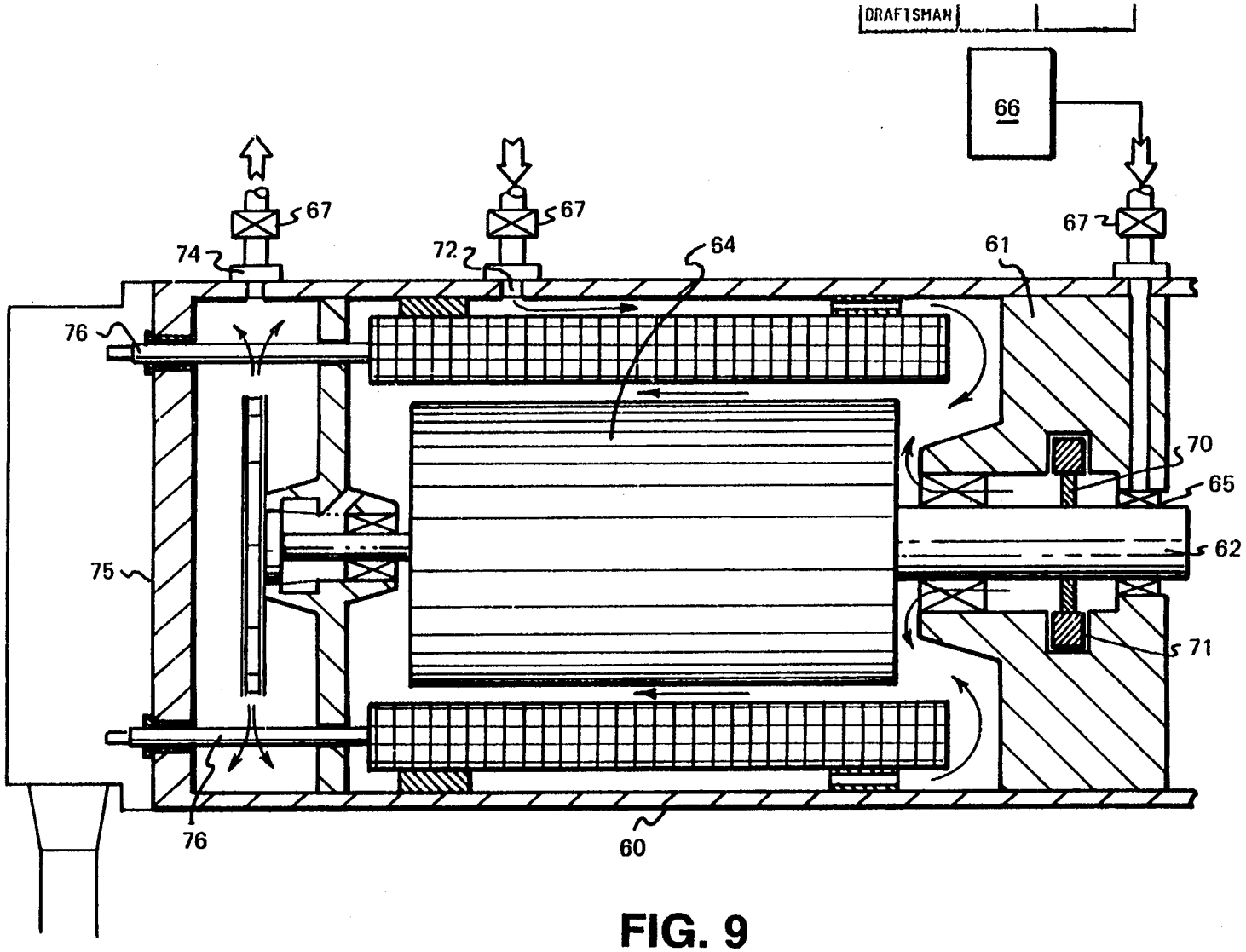

FIG. 4 graphically illustrates for comparison the relationship between the total pressure head developed and the axial length of the rotating impeller assemblies, for the unit of FIGS. 1 and 2 and for a pump or compressor unit of conventional design;

FIG. 5 is a sectional side view of a second pump or compressor unit embodying the invention;

FIG. 6 is a like view of a third pump or compressor unit embodying the invention;

FIG. 7 is a fragmentary view showing a portion only of the impeller assembly of FIG. 6, to illustrate the flow paths therethrough; and FIG. 8 is a part sectional side view of a pump or compressor unit incorporating the impeller assembly of FIGS. 6 and 7, in use in a well, and FIG. 9 is a sectional side view of an electric motor unit for use in a pump or compressor unit embodying the invention.

Figure 3:
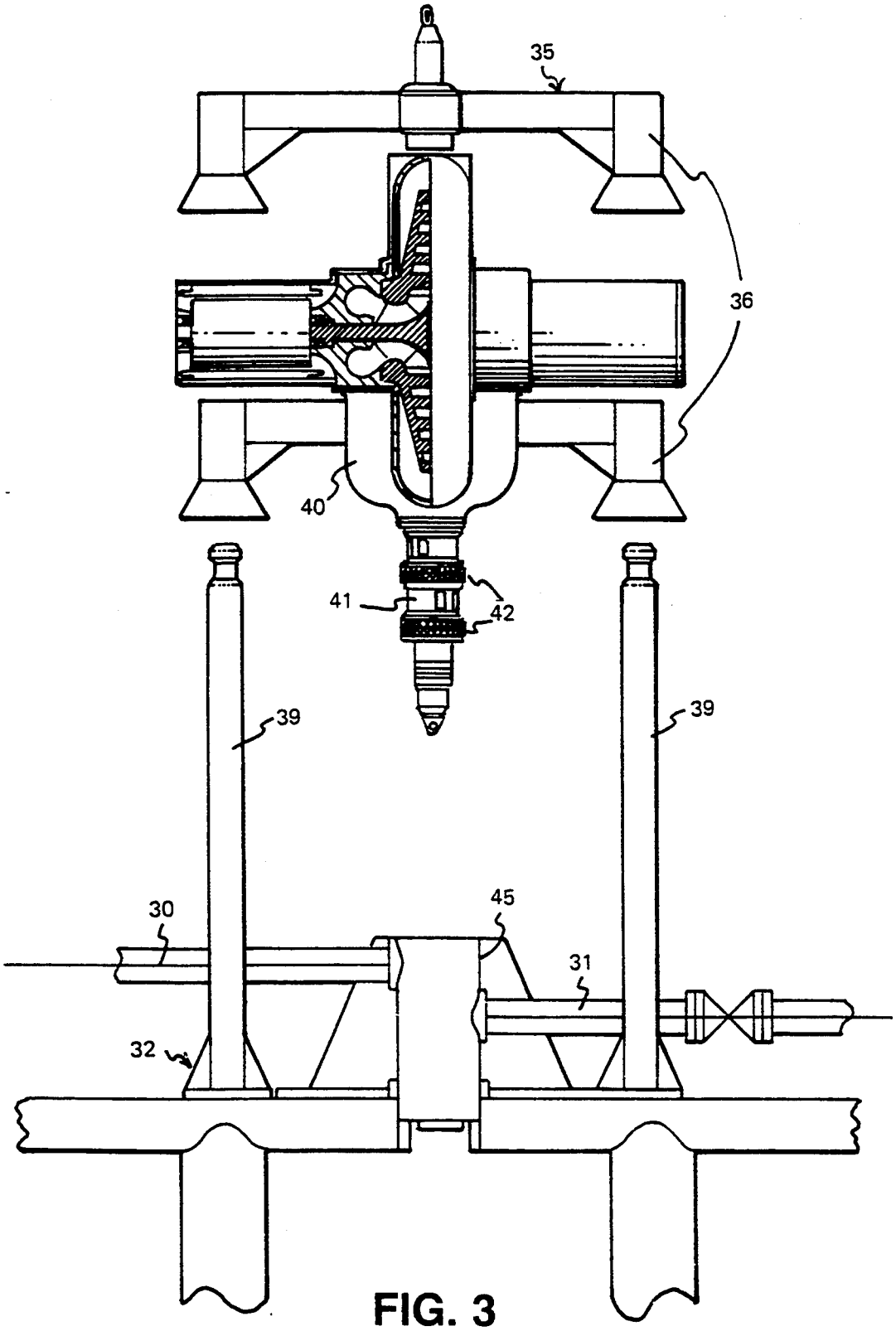
FIG. 3 shows the pump or compressor unit of FIG. 1 in a subsea application.

The pump or compressor unit 1 illustrated in FIGS. 1–3 comprises two co-operating axially aligned impeller assemblies 2 and 3 which can be rotatably driven about the common axis by respective electric motors 4 and 5. The impeller assemblies comprise respective annular backing or support plates or discs 6 and 7 of nearly flat frusto-conical form positioned with the outer edges closer than the inner edges. The discs 6 and 7 each carry five circular rows or rings 10 and 11 of equi-angularly spaced impeller vanes or blades 14 and 15, with all but the outermost rings received between an adjacent pair of rings extending from the other backing plates. The blades 14,15 of each ring extend axially close to the backing discs, so that the axial lengths of the blades of successive rings are reduced in the radially outward direction.

As shown in FIG. 1, each annular backing disc 6,7 has a hub portion 15, extending away from the impeller blades, by which it is journalled in a respective one of axially aligned sleeve-like end portions 16 of a casing of the unit. The space between the impeller assemblies communicates with a space within each end portion 16, to define an inlet or suction chamber 17 for fluid which is to be moved by the impeller assemblies. The end walls of the end portions 16 are each apertured to receive therethrough a drive shaft 19 extending from the adjacent electric motor and connected to the hub portion 15 of the associated impeller assembly by a web or spider 20. The incoming fluid flows through the spider 20 which can be constructed so as to have a pumping and/or mixing effect on the fluid. The electric motors 4 and 5, which are received within cylindrical motor housings 21 extending outwardly from the end walls of the end portions 16.

The casing includes between the two end portions 16 a central portion 22 accommodating the impeller assemblies and providing an outlet or discharge chamber 23.

As appears from the axial view of FIG. 2, the impeller blades 14,15 have cross-sectional shapes, and locations on the backing discs 6 and 7, such that counter-rotation of the backing discs in the direction of the arrows 24 causes fluid in the inlet chamber to be moved radially outwardly through successive rings of the blades until it flows through the outermost blade ring of the assembly into the discharge chamber.

As compared with the convention design of axial flow type of contra-rotating pump or impeller unit as exemplified in FIG. 4 of U.S. Pat. No. 2,234,733, the unit 1 provides the possibility of developing a given pressure head in a much shorter axial length of actual impeller assembly as indicated in FIG. 4, which shows how the total head developed varies with increasing impeller assembly length for both the contra-rotating (CR) design of the present invention and the conventional design.

It will be evident from FIG. 1 that a certain amount of leakage can occur over the blades 10,11 from the pressure side to the suction side. The gap between the blade tips and the opposed disc 6,7 can be minimised but with a possibility of disadvantageous mechanical contact, as may occur because of distortion of the discs or because of bending or vibration of the drive shafts 19. The invention accordingly provides various possibilities for minimizing this leakage problem.

As shown in FIG. 1A, which is a fragmentary sectional side view of the discs 6 and 7 of one of the blades 10, the tips of the blades of each annular array of blades are all connected together by a support ring 25. The mechanical strength of the impeller assembly is thereby substantially enhanced. Moreover, the support ring 25 can be received in an annular slot 26 formed in the opposing disc 7, so that any axial displacement of the blades is accommodated. The protection against leakage can be enhanced by seal means operative between the support ring 25 and the sides or floor of the annular slot 26.

In an alternative arrangement shown in FIG. 1B, which is again a fragmentary sectional side view of the disc 6 and one of the blades 10, a bolt 27 extends through a support ring 28 and the blade 10 into a tapped hole in the disc, permitting manufacturing simplifications for the impeller assembly and a wider choice of materials for the blades. In FIG. 1B, knife edge seal elements 29 extend axially from the support ring 28 to make a flexible seal against the disc 7, which need not in this instance be provided with an annular slot.

The pump or compressor unit 1 of FIGS. 1 and 2 has a variety of applications, and FIG. 3 illustrates its use in a subsea context, as a compressor for fluid, for example, a multi-phase fluid such as a mixture of gas and oil and water, between inlet piping 30 and outlet piping 31 of a subsea station 32. The unit is carried by a support frame 35 having guide tubes 36 with downwardly opening lower funnel portions, by which the unit is guided on guide wires extending down to guideposts 39 into correct operational position relative to the subsea station. The unit 1 additionally comprises for this application a central outer housing 40 which extends downwardly from around the casing central portion and terminates below in a connection probe 41, provided with axially spaced sealing means 42, for reception in a sleeve-like receptacle 45 into which the ends of the inlet and discharge piping communicate.

Reception of the probe 41 into the receptacle 45 effect sealed communication between the inlet piping 30 and the inlet chamber 17 of the unit, and between its outlet chamber 24 and the discharge piping 31. The probe 41 carries at its lower end connector means for establishing electrical power and control signal communication between the unit 1 and the station 32, and for connection of the unit to a supply line for the barrier fluid. The unit 1 can readily be constructed so as to be both compact and robust, which are characteristics of special importance of this type of application.

FIG. 5 illustrates a second pump or compressor unit 100 embodying the invention. The unit of FIG. 5 is driven by electric motors corresponding to the motors 4,5 of the unit of FIGS. 1 and 2 and identified by the same reference numerals.

In the unit FIG. 5, the electric motor 5 drives a pair of axially spaced annular backing or support plates 101 and 102, by way of a somewhat frusto-conical hub or spider portion 104 provided with apertures 105 and connected to the plate 102. The backing plates 101 and 102 are connected to rotate together at their outer peripheries by an outer annular wall 106 of semi-cylindrical cross-section.

Received between the two backing plates 101 and 102 is a support disc 110 carried at an end of a drive shaft 111 extending from the motor 4 and extending through a fitting 112 on which the support plate 101 is journalled. The sides of the support plates 101 and 102 adjacent the disc 110 carry respective concentric rings 115,116 of angularly spaced impeller blades, and the two sides of the intermediate support disc 110 carry respective co-operating rings 117,118 of angularly spaced impeller blades, which extend axially between the rings 115,116. The impeller blade rings 116 and 118 are in similar relationship to the impeller blade rings 10 and 11 of FIGS. 1 and 2, so as to move fluid radially outwardly, but the impeller blade rings 116 and 118 are configured so as to convey fluid radially inwardly, on contrary rotation of the disc 110 and the plates 101 and 102. Fluid entering through the apertures 105 is thus moved successively outwardly and then inwardly within the working chamber defined by the plates 101 and 102 and the wall 106.

The housing 21 of the motor 4 is secured to the fitting 112, the interior of which functions as a discharge chamber 124 discharging outwardly of the unit through an outlet 125. The housing 21 of the motor 4 is secured to a casing 120 which encloses the impeller assemblies and provides an inlet or suction chamber into which fluid can enter through an inlet 122.

The unit 100 has applications similar to those of the unit 1 and can be modified to accommodate compression of a gaseous fluid, or the gaseous phase of a multiphase fluid, by successively, reducing the axial length of the impeller blades, as in the unit 1.

The pump or compressor unit 200 shown in FIGS. 6 and 7 employs the successively radially outward and inward movement of the unit 100 in a multi-stage arrangement.

As best appears from FIG. 6, a first or inner drive shaft 201 carries at regularly spaced positions along it a plurality of backing plates 203 extending at right angles to the shaft axis. Each of the backing plates except for the uppermost one carries at its upper side two concentric rings 205 of axially extending angularly spaced impeller vanes, and at its lower side a single such ring 207, at a position radially between the two upwardly extending rings. The uppermost backing plate has only the single downwardly extending ring 207.

A second or outer drive shaft 202 is of tubular form and concentrically surrounds the inner drive shaft 201. The outer drive shaft 202 carries internally a plurality of axially spaced annular shelves 204 extending at right angles to its axis. Except for the lowermost shelf, each shelf 204 carries two concentric rings 206 of angularly spaced impeller blades extending axially upwardly. The downwardly extending impeller blade ring 207 of the backing plate immediately above the shelf is closely received between these rings 206. Underneath each shelf 204 except for the lowermost shelf, which carries only the two upwardly extending impeller blade rings, a single ring 208 of impeller blades extends downwardly between the upwardly extending concentric impeller blade rings, 205 of the immediately underlying backing plate.

The inner and outer drive shafts 201 and 202 are rotated by respective electric motors 221 and 222, shown in FIG. 8, in opposed directions, and the impeller blade configurations are such that fluid is carried upwardly through the unit by a series of successively radially outward and then radially inward movements.

Thus, referring to FIG. 7 which shows part only of only the lowermost backing plate 203 and the two lowermost shelves 204, fluid from below the lowermost shelf is drawn upwardly and radially outwardly by the impeller rings it carries, in co-operation with the downwardly extending ring of the backing plate. The fluid is then drawn radially inwardly through the set of three impeller rings immediately above the lowermost set of rings. This sequence of movements is repeated successively upwardly of the lowermost rings, until the fluid discharges above the uppermost backing plate.

Although the number of radially adjacent co-operating impeller vane rings can be selected according to requirements, as can the number of backing plates 203 and shelves 204, it will be appreciated that a unit of the kind shown in FIGS. 6 and 7 can be transversely quite compact, and although not limited to such use, it is particularly suited for use in downhole applications, or "riser based" offshore systems. The unit 200 is accordingly shown in FIGS. 6–8 as including a tubular housing 225 within which the motors 221 and 222 are concentrically mounted by webs 226, the upper part of the housing providing discharge piping for the extracted fluid. The housing is shown as being itself received in a tubular well casing 230.

A pump or compressor unit of the configuration shown in FIGS. 6–8 provides for a very high developed head per unit length. Again, single phase fluids as well as multi-phase fluids can be readily handled, for example oil or water substantially without gas content, or a gas substantially without liquid content, or a mixture of both. Where the fluid being pumped is compressible, the compression can be accounted for within the structure of the unit by successive reductions in the axial length of the impeller blades, from the suction to the discharge side.

As shown in respect of motor 5 of FIG. 5 only, it is advantageous to circulate a barrier fluid, typically a dielectric oil, through the inferior of each of the motor housings 21, for lubrication of the motor bearings and for cooling of the motor. Barrier fluid is accordingly supplied by a pump 50 from a sump 51 to which it returns after passage through the housing.

The motor housing 21 can be designed for full process fluid pressure, so as to have the same rating as pipelines and other production equipment with which the unit is employed. Only one single-acting dynamic shaft seal 54 is required to separate the interior of the motor housing, at the clean side of the seal, from the working chamber interior of the casing 120. The barrier fluid is kept at a pressure sufficiently high to ensure that any leakage, which may be a controlled leakage, is from the clean side to the process side.

Alternatively, any pump or compressor unit embodying the invention can employ a motor unit of the kind shown in FIG. 9, with particular advantage for high pressure units and/or large motor ratings the unit of FIG. 9 comprises a housing 60 provided with an end fitting 61 through which a drive shaft 62 extends outwardly to an impeller assembly to be driven from a 4-pole electric motor 64. The shaft 62 extends through a mechanical seal 65 subjected to over-pressurized barrier fluid from a source 66, supplied by way of a failsafe isolation valve 67. A balancing piston 70 and labyrinth seal 71 separate the high pressure barrier fluid zone from the main volume of the housing 60 containing the motor 64, through which barrier fluid from an inlet 72 is circulated at a lower pressure to an outlet 74. Fluid circulation is aided by an impeller 75 driven by the motor 64.

A failure of the seal would merely expose the motor casing to the pumped fluid pressure, and there would be no leakage to or from atmosphere the external connections for the motor casing, for the barrier fluid and for electric cables 76 have static seals and these secure system integrity if the shaft seal should fail.

The invention can of course be embodied in a variety of ways other than as specifically described.

I claim:

1. A pump or compressor module for undersea use comprising a housing having a pump or compressor unit received therein, said pump or compressor unit comprising:

first and second impeller assemblies, means mounting said first and second impeller assemblies for rotation about a common axis, said first impeller assembly comprising first and second support members spaced apart along said common axis, wall means connecting together said first and second support members remotely from said common axis, and at least one annular array of impeller blades on each of said support members, said impeller blade arrays being located between said support members and said second impeller assembly comprising a third support member located axially between said first and second support members and at least one annular array of impeller blades on each side of said third support member, said impeller blades being adapted to move a fluid in a generally radial direction between said first and said third support member and in the opposed generally radial direction between said second and said third support members, driving means for driving said first and second impeller assemblies in opposed directions about said common axis, said driving means comprising first and second electric motors having respective drive shafts drivingly connected to said first and second impeller assemblies respectively, first and second motor casings having therein said first and second electric motors respectively, said motor casings being within said housing, a seal compartment in each of said motor casings, a drive shaft seal within each of said compartments, barrier fluid circulating means for circulating barrier fluid in each of said motor casings, said barrier fluid circulating means being adapted to supply said barrier fluid to each of said seal compartments at a higher pressure than to the rest of said motor casing, fluid inlet and fluid outlet means adapted respectively to guide fluid to and from said first and second impeller assemblies; and guide means carried externally by said housing for guiding said module to a loading location at a subsea station having fluid connection ports.

2. The pump or compressor module of claim 1, wherein said guide means comprises a support frame mounting said housing, and guide tubes for reception therein of guide posts of said subsea station.

3. The pump or compressor module of claim 1, wherein said guide means comprises a plurality of guide tubes for moving therein substantially upright guide posts of said subsea station.

4. The pump or compressor module of claim 1, wherein said housing has end portions accommodating said first and second electric motors respectively and a central portion between said end portions accommodating said impeller assemblies, and providing an inlet chamber communicating with said fluid inlet.

* * * * *